United States Patent [19]

Kroupa et al.

[11] Patent Number: 4,598,537

[45] Date of Patent: Jul. 8, 1986

[54] METHOD OF MANUFACTURING CORE YARNS FROM FIBER BANDS

[75] Inventors: Petr Kroupa; Rudolf Sramek; Jiri Fantl, all of Liberec, Czechoslovakia

[73] Assignee: Elitex, koncern textilniho strojirenstvi, Liberec, Czechoslovakia

[21] Appl. No.: 573,045

[22] Filed: Jan. 23, 1984

[51] Int. Cl.[4] ..... D01H 5/28; D02G 3/22; D02G 3/36

[52] U.S. Cl. ..... 57/5; 57/6; 57/315; 57/328

[58] Field of Search ..... 57/328, 5, 6, 350, 315

[56] References Cited

U.S. PATENT DOCUMENTS

| | | | |
|---|---|---|---|
| 3,487,619 | 1/1970 | Field, Jr. | 57/328 |
| 4,387,487 | 6/1983 | Nakahara et al. | 57/328 X |
| 4,463,549 | 8/1984 | Kajita et al. | 57/328 |

*Primary Examiner*—John Petrakes

[57] ABSTRACT

Method of manufacturing core yarns from fiber bands. A part of the fibers of a fiber band is released from the fiber band and is deflected. These deflected fibers do not participate in the spinning process, but are wrapped around the twisted core in a plurality of reinforcing winds. The method of the invention overcomes the problems of manufacturing yarns without requiring expensive and complicated mechanical elements.

4 Claims, 2 Drawing Figures

METHOD OF MANUFACTURING CORE YARNS FROM FIBER BANDS

Figure 1:
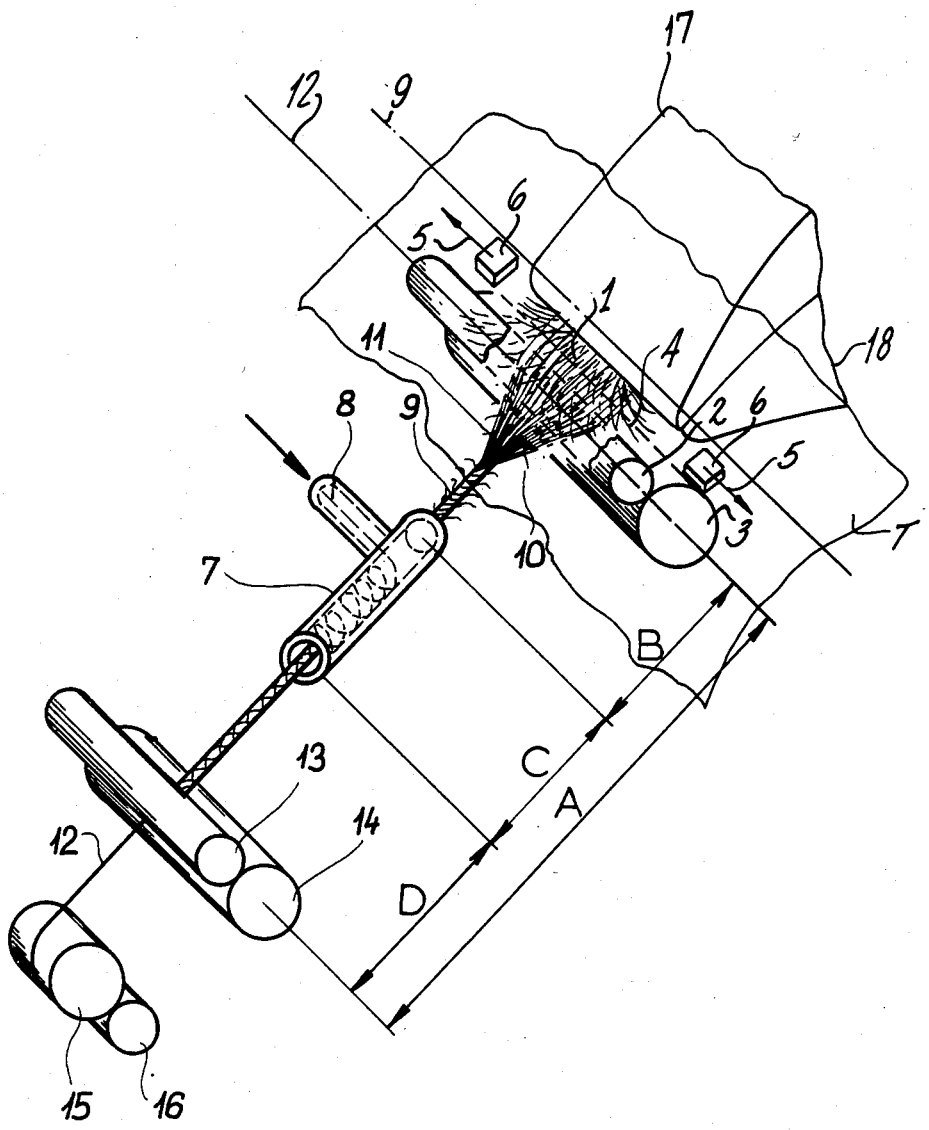

The present invention relates to a method of manufacturing core yarns from fiber bands. The majority of the yarn manufacturing methods hitherto known use fiber twisting for the reinforcement of fiber systems. The limiting factor of the productivity of fine spinning machines is the twist imparting device. Penumatic systems for manufacturing yarns replace, as designed, the twist imparting machine elements by a pneumatic rotation field. Twists can be imparted to fibers at a high frequency by a rotating air jet or vortex.

Several methods of imparting false twists to fibers are known:

(1) In one of the methods hitherto known, the twist imparting element imparts less twist to the boundary fibers than to the fibers of the main band. Upon untwisting, said boundary fibers form true twist turns on the non-twisted core. In this manner, long staple fibers can be spun, since the turns are formed by only short fiber sections. This system can be completed by a variant with filament silk in the core.

(2) In a further known yarn manufacturing method, the twisting nozzle sucks fibers for the core from one band, and fibers for the shell from another band. While the core is being given a false twist by a nozzle, the fibers for the shell contact the core without twist in a wound by a true twist around the core only at the twisting stage. The disadvantages of this system are that the joining and wrapping of the fibers is random, and that the shell fibers are insufficiently joined with the core.

(3) A further known system uses two nozzles, arranged one after the other, for forming yarn. In the first nozzle, the fiber band is given a false twist, and in the second nozzle the fiber band is untwisted. The slightly twisted surface fibers are released and formed windings around the core. The disadvantage of this system is its high demands on maintaining a constant twisting and untwisting process. Both nozzles must be adjusted in such manner that twisting and also deflecting the yarn for the purpose of the partial releasing of surface fibers are constant. The surface fibers in this system are released upon deflecting the yarn by friction about shaped insets.

(4) In another known system, the fiber ends are released, upon being false twisted, by an air jet. During the following untwisting, windings about the yarn are formed. In this system, the main disadvantage is that the length, as well as the number of released fiber ends, are insufficient.

The present invention has among its objects the provision of a method of manufacturing core yarns from fiber bands which mitigates the disadvantages of the spinning methods hitherto known. The method according to the present invention consists, namely, in that free ends of a pair of staple fibers are released by the action of an external force from the fiber band during its drafting, and are simultaneously deflected from the direction of the main fiber band stream, whereupon the fiber band thus formed, with the deflected fiber ends, is false twisted as long as the twisted yarn core is formed therefrom. The deflected fiber ends are attached successively to said yarn core upon its untwisting; during the spontaneous untwisting of the yarn core, winds are formed by adhesion between said fibers and the yarn core, which are wound around the untwisted yarn core by a true twist, thus reinforcing said core.

The method of manufacturing yarn according to the present invention forms yarn with good properties by using extremely simple means for performing such method.

Figure 2:
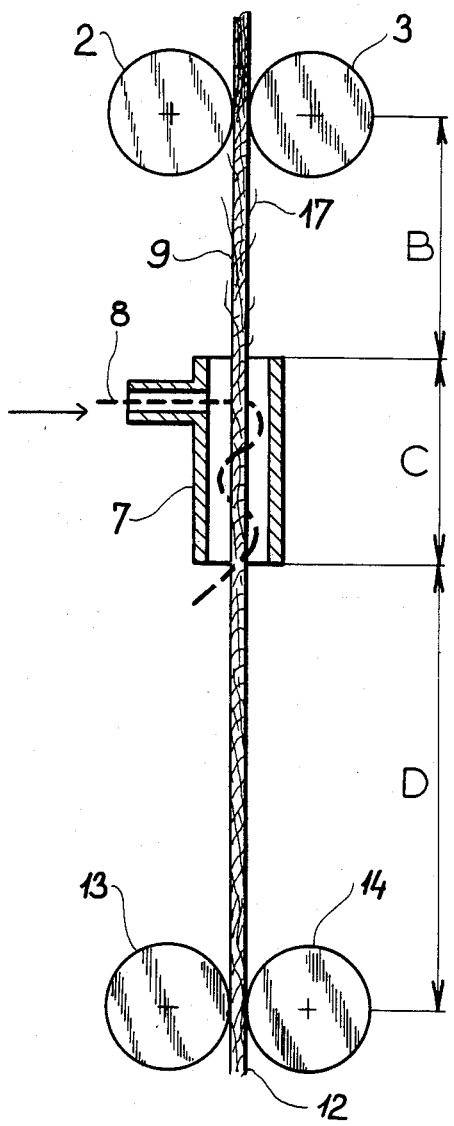

The processing of fibers to yarns by the method according to the present invention is described in the following specification and illustrated in the accompanying drawings, in which:

FIG. 1 is an axonometric view illustrating the method of processing fibers to yarns according to the present invention; and FIG. 2 is a diagrammatic representation of the structural changes of the fiber formation in the course of processing the fibers according to the present invention.

A fine band 1 of parallelly arranged fibers, coherent by mutual engagement, is fed by a drafting mechanism, the mutual fiber coherence being proportional to their density. With a low density, the mutual fiber coherence is low. The fiber band 1 is fed into the nip of a pair of feeding cylinders 2, 3 by means of a pair of draft aprons 17, 18. From the pair of feeding cylinders 2, 3, the fibers are fed to a spinning zone A. In front of the nip of the said feeding cylinders 2, 3 some fiber ends 4 are deflected from the main stream of the fiber band 1 by a gaseous flow, e.g. air, sucked into sucking tubes 6. However, it is also possible to secure such effect by other external forces, e.g. electrostatic or mechanical forces. However, the decisive factor consists in that said external forces must act exclusively in the nip plane, i.e. in the plane defined by the nip line carrier P of the pair of feeding cylinders 2, 3, and the parallel nip line carrier of the pair of aprons 17, 18. The intensity of this action must cause a deflection of at least 3% of fibers 4 from the total number of fibers in the fiber band 1, with an inclination of at least 30° relative to the direction of flow of the main stream of the fiber band 1.

The deflection of fibers ends 4 is proportional to the direction and the intensity of the forces acting upon them. It is appropriate that the deflection of the fiber ends 4 be in the plane of the nip of feeding cylinders 2, 3 which feed the fiber band 1 into the twisting zone B, the length of the deflected fiber ends being at least 3 mm. Downstream of the twisting zone B, yarn twisting is performed in a rotative pneumatic field C by a tangential air stream indicated by dash line 8 in the nozzle 7, while in the twisting zone B the fiber band 1 is twisted to yarn. Such twist runs back as far as the nip of the feeding cylinders 2, 3, where a twisting triangle 11 with free fiber ends 4 is formed. The said free deflected fiber ends 4 are not entrained by the twisting forces in the twisting triangle 11, and thus are not twisted like the fibers inside the fiber band 1 proper. In such manner, an intensively twisted fiber core 9 is formed, which is wrapped by winds 17 (FIG. 2) of free fiber ends 4.

The fiber system continues to move in the pneumatic rotative field C, until the false twist is successively removed in the untwisting zone D upstream of withdrawing pinch rollers 13, 14. In the core 9, twist is reduced to a zero value, and the winds 17 of the free fiber ends 4 are wound in the opposite direction, now wrapping the substantially untwisted core 9 by a true twist. The winds 17 of the free fibers ends 4 now exert a radial force acting upon the fibers of core 9, which are thus compressed, thus giving rise to friction between the fibers, which reinforces and compresses the fiber system to form a bundle yarn 12, which is withdrawn by the aforesaid pair of withdrawing rollers 13, 14 and is wound onto a bobbin 15 by a winding mechanism 16.

Although the invention is described and illustrated with reference to a single preferred embodiment thereof, it is to be expressly understood that it is in no way limited to the disclosure of such preferred embodiment but is capable of numerous modifications within the scope of the appended claims.

We claim:

1. Method of manufacturing core yarn, comprising drafting a staple fiber sliver in a drafting mechanism with drafting cylinders to form a fiber band, processing the thus formed fiber band by a false twist in a twisting zone followed by an untwisting thereof, wherein the free ends of a part of the staple fibers are released by the action of an external force from the fiber band upstream of the nip of the cylinders of the drafting mechanism which feed the fiber band to the twisting zone, said force being applied within the plane of the nip of such cylinders during its drafting, and are simultaneously deflected from the direction of the main fiber band stream, the fiber band thus formed with the deflected fiber ends is then twisted by a false twist to form a twisted yarn core, the said deflected fiber ends being attached successively to the core during the untwisting of the core, and upon the spontaneous untwisting of the yarn core said fiber ends are wound about the untwisted yarn core by a true twist due to adhesion between said fiber ends thus wound about the yarn core to reinforce it.

2. A method as claimed in claim 1, wherein the length of the fiber ends released by the action of said external force is at least 3 mm.

3. A method as claimed in claim 1, wherein the free fiber ends are deflected from the fiber band through an angle of at least 30°.

4. A method as claimed in claim 1, wherein at least 3% of free fiber ends are deflected from the total number of fibers in the fiber band.

* * * * *